US005678581A

United States Patent [19]

Hsu

[11] Patent Number: 5,678,581

[45] Date of Patent: Oct. 21, 1997

[54] APPARATUS FOR CLEANING AN AIR PUMP SILENCER

[75] Inventor: Chien Lai Hsu, Hsinchu Hsien, Taiwan

[73] Assignee: United Microelectronics Corporation, Taiwan, China

[21] Appl. No.: 540,071

[22] Filed: Oct. 6, 1995

[51] Int. Cl.[6] ..... B08B 9/00

[52] U.S. Cl. ..... 134/104.4; 134/149; 134/152; 134/157

[58] Field of Search ..... 134/140, 85, 137, 134/152, 153, 148, 149, 157, 161, 104.4

[56] References Cited

U.S. PATENT DOCUMENTS

| | | | |
|---|---|---|---|
| 2,619,430 | 11/1952 | Fink | 134/152 |
| 2,756,455 | 7/1956 | Slaughter, Sr. | 134/153 |
| 2,763,564 | 9/1956 | McKenzie et al. | 134/152 |
| 2,763,565 | 9/1956 | McKenzie et al. | 134/157 |
| 2,907,688 | 10/1959 | Payne et al. | 134/152 |
| 3,240,216 | 3/1966 | Sadwith | 134/152 |
| 3,606,897 | 9/1971 | Tobin, III et al. | 134/152 |
| 3,998,656 | 12/1976 | Grotto | 134/153 |
| 4,044,951 | 8/1977 | Waite | 134/153 |
| 4,090,309 | 5/1978 | Rollins . | |
| 4,140,543 | 2/1979 | Soleri et al. | 134/153 |
| 4,299,245 | 11/1981 | Clapper | 134/152 |

*Primary Examiner*—Frankie L. Stinson

*Attorney, Agent, or Firm*—Cushman Darby & Cushman Intellectual Property Group of Pillsbury Madison & Sutro LLP

[57] ABSTRACT

A cleaning apparatus for cleaning an air pump silencer is disclosed. The cleaning apparatus comprises a closed housing. In the closed housing, at least one rotary part, each including a fixing plate and a support base for fixing the silencer is provided. Water from a water tank is injected into the silencer by first and second pipe sets. The first pipe set includes a straight pipe and a bent pipe mounted on the fixing plate. The second pipe set includes a straight pipe and a bent pipe mounted on the support base. During cleaning, these pipes enter the silencer and inject water to clean the inner walls of the silencer. A driving portion including a motor for driving the rotary parts is provided in the closed housing and is driven by a control circuit. When the rotary parts rotate, all the inner walls of the silencer can be completely cleaned by the pipes. Wash water is collected in an acid tank in the lower portion of the closed housing to isolate hazardous materials cleaned from the silencer.

12 Claims, 4 Drawing Sheets

APPARATUS FOR CLEANING AN AIR PUMP SILENCER

BACKGROUND OF THE INVENTION

1. Field of the Invention

The present invention relates to cleaning machines, and more specifically, to an apparatus for cleaning an air pump silencer.

2. Description of Related Art

Many semiconductor manufacturing processes are carried out in low pressure environments. Such environments are established by using an air pump to evacuate air from a chamber. The pumps are rather noisy and therefore the air outlets of the pumps are fitted with silencers.

FIG. 1 (Prior Art) is a schematic diagram of an QDP-80 dry pump silencer, designated generally by reference numeral 10, which is manufactured by Edware company. Silencer 10 comprises a tube 11, two caps 13, two inner axis 15*a* and 15*b*, and a spacer 17 which separates the silencer into to sections: a first section 1 and a second section 2. By fixing silencer 10 at the air outlet of the dry pump, most pump noise is absorbed when air is being evacuated.

Often, the manufacturing processes carried out in the evacuated chamber require the use of chemicals. Reactions take place within the chamber which leave or create particles which are pumped out and tend to deposit on the inner walls of silencer 10. As the deposited particles increase, the noise absorption performance of the silence is diminished. Therefore, silencer 10 has to be cleaned to remove particles that have accumulated after long use.

In the past, silencers were cleaned by hand. The silencers were washed by immersing them in water or by being placed in a water stream in order to remove the particles coated on the inner wall. However, cleaning has been difficult. As shown in FIG. 1 (Prior Art), caps 13 and tube 11 form dead angle regions 18. Particles accumulated around dead angle regions 18 are difficult to remove by hand-washing. Therefore, silencer 10 is not completely cleaned. Furthermore, hand washing the silencer can be dangerous. Some of the accumulated particles are chemicals which react with water to form poisonous gases and liquids. These gases and liquids not only contaminate the environment but can harm to those who clean the silencer.

SUMMARY OF THE INVENTION

Accordingly, the present invention provides an apparatus for automatically cleaning a silencer to protect people from the harmful gases and liquids generated during the cleaning process.

The present invention also provides an apparatus for cleaning a silencer in a closed space to prevent the contamination caused by the gases and liquids.

The present invention further provides an apparatus for cleaning a silencer more completely than it can be cleaned by hand.

The apparatus for cleaning a silencer according to a preferred embodiment of the present invention comprises a closed housing. In the closed housing, at least one rotary part each including a fixing plate and a support base for fixing the silencer is provided. A first pipe set including a straight pipe and a bent pipe is mounted on the fixing plate. A second pipe set including a straight pipe and a bent pipe is mounted on the support base. These pipes enter the silencer and inject water to clean the inner walls of the silencer. A driving portion including a motor for driving the rotary parts is provided in the closed housing and is driven by a control circuit. When the rotary parts rotate, all the inner walls of the silencer can be completely cleaned by the pipes. The apparatus further comprises a water tank and an acid tank in the lower portion of the closed housing. The water tank provides water for cleaning the silencer. The acid tank is provided for collecting the liquids produced by cleaning the silencer. Therefore, poisonous liquids are isolated to prevent the contamination of the environment.

BRIEF DESCRIPTION OF THE DRAWINGS

Other objects, features, and advantages of the present invention will become apparent from the following detailed description of the preferred but non-limiting embodiments. The description is made with reference to the accompanying drawings in which.

DETAILED DESCRIPTION OF PREFERRED EMBODIMENT

Figure 1:
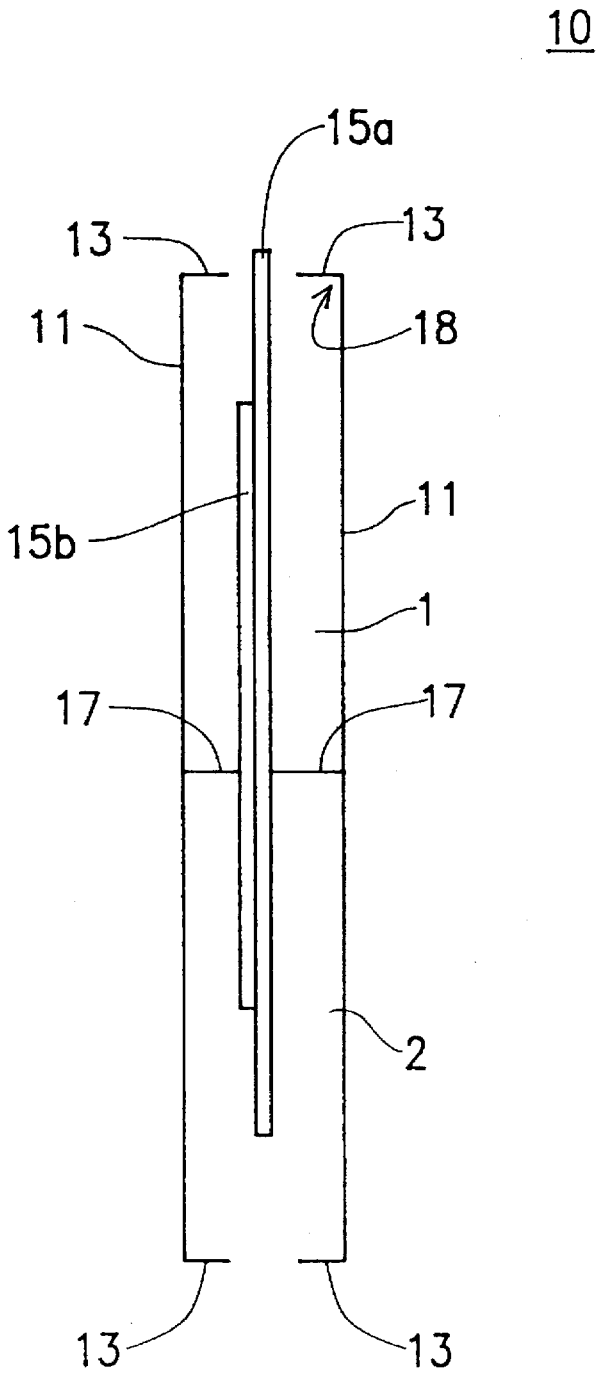
FIG. 1 (Prior Art) is a schematic diagram illustrating a silencer.
Figure 2:
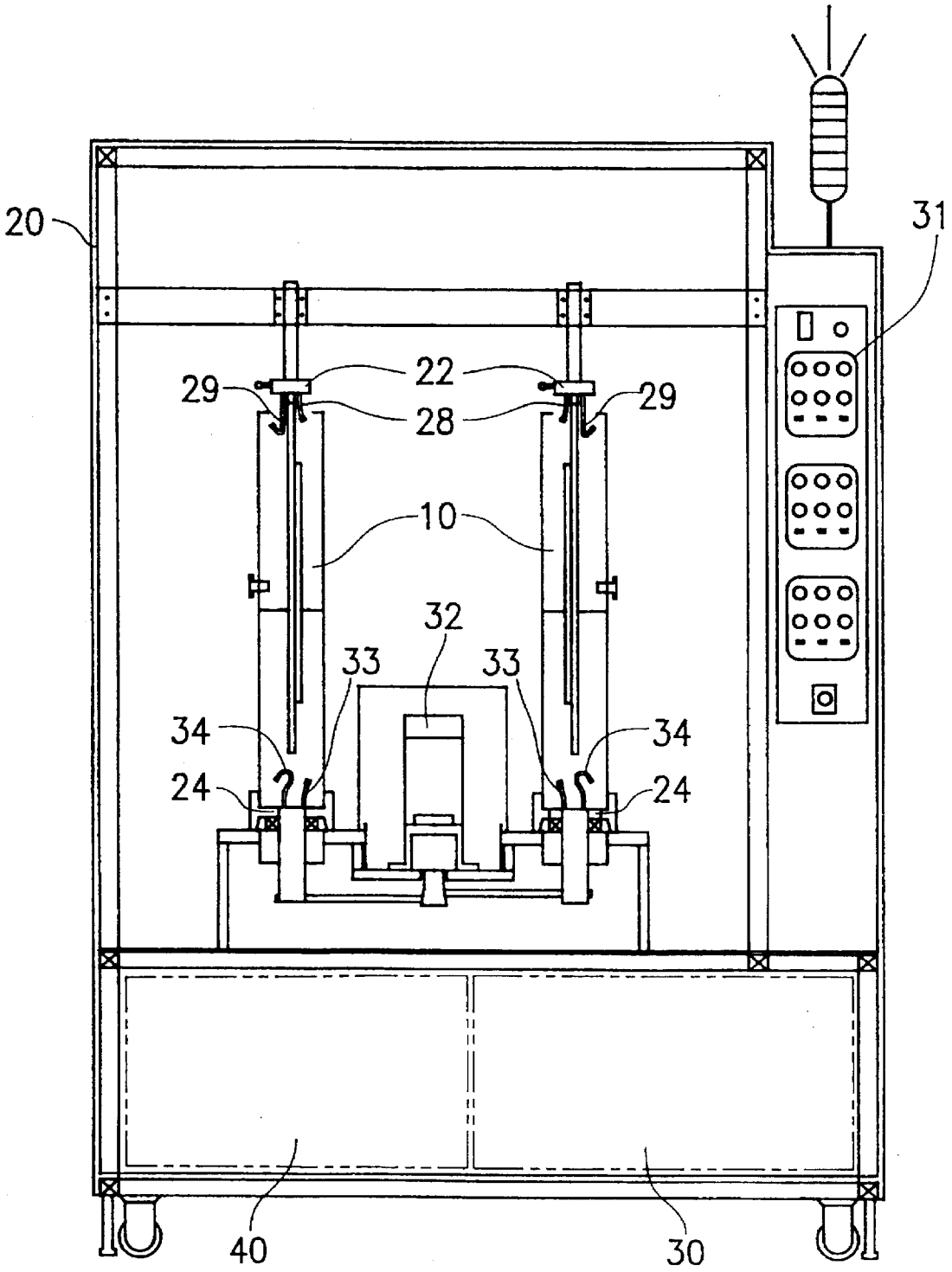
FIG. 2 is a schematic diagram (front view) of an apparatus according to the present invention for cleaning silencers.
Figure 3:
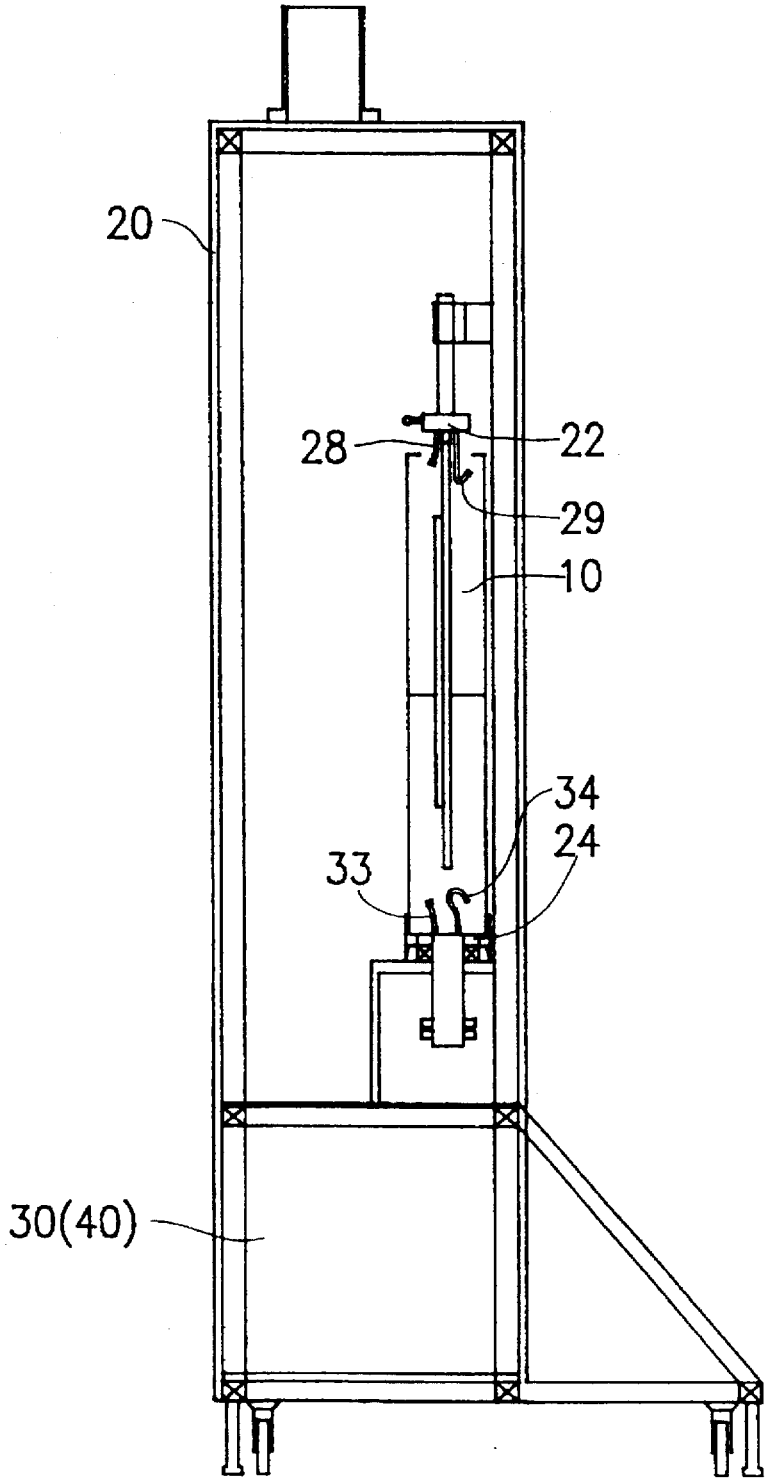
FIG. 3 is a schematic diagram (side view) of an apparatus according to the present invention for cleaning silencers.

FIGS. 2 and 3 are respectively schematic front and side views of a preferred embodiment of the apparatus for cleaning a silencer according to the present invention. In order to prevent the outflow of undesirable gases and liquids generated during the cleaning process of silencer 10, a closed housing 20 is provided. The structure of silencer 10, as is illustrated in FIG. 1, comprises a tube, two caps at both opposite ends of the tube, and an inner axis fixed on the tube by a spacer. The spacer separates silencer 10 into a first section and a second section. Each cap has an opening at the center. There is at least one rotary part inside closed housing 20. In the preferred embodiment, two rotary parts each including a fixing plate 22 and a support base 24 for vertically fixing silencers 10 are provided. The lower end of a silencer 10 being cleaned is supported by support bases 24 and upper ends of silencers 10 are fixed by fixing plates 22.

A first pipe set including a straight pipe 28 and a bent pipe 29 is mounted on fixing plate 22. The first pipe set is inserted into the first section of silencer 10 through the opening of the upper cap. Straight pipe 28 and bent pipe 19 can inject water to wash the inner wall of silencer 10 in the first section. A space must be left between straight pipe 28 and bent pipe 29 for the inner axis of silencer 10, because fixing plate 22 may fix silencer 10 by attaching the inner axis. The pipe set will be described in further detail in the following paragraphs.

A second pipe set including a straight pipe 33 and a bent pipe 34 is mounted on support base 24. These pipes are also inserted into silencer 10 through the opening of the lower cap and inject water to wash the inner wall of silencer 10 in the second section. Since the inner axis is shorter in the second section and more space exists in the lower end of silencer 10, there are fewer limitations on the specific arrangement of pipes 33 and 34.

In order to obtain good cleaning, a driving portion 32 including a motor for driving the rotary parts is provided in closed housing 20. Driving portion 32 causes support bases 24 to rotate, thus also rotating silencer 10. Since the pipe sets are fixed, water injected from the pipes can reach all portions of the inner walls of silencer 10 as it rotates. Driving portion 32 is controlled by a control circuit which can be initialized or adjusted by control panel 31 during the cleaning of silencer 10.

The cleaning apparatus further comprises a water tank 30 and an acid tank 40 in a lower portion of closed housing 20. Water tank 30 provides water to the pipes for cleaning silencers 10. Acid tank 40 collects the liquids and any particles contained therein as a result of cleaning. Therefore, poisonous liquids and particles are isolated and the environmental contamination is avoided.

As mentioned above, chemical particles can not be easily removed around the adjoining regions of the inner wall and caps of silencer 10, i.e., dead angle regions 18 illustrated in FIG. 1 (Prior Art), the bent pipes 29 and 34 of the pipe sets are designed to overcome this problem. Bent pipe 29 is pointed at upper dead angle region 18 of the first section and bent pipe 34 is pointed at lower dead angle region 18 of the second section of silencer 10. Therefore, the water injected from bent pipes 29 and 34 can directly and completely remove the particles accumulated in regions 18 of silencer 10.

On the other hand, straight pipe 28 is designed to clean all regions in the first section other than dead angle region 18. In order to cover a wider range in the tube, straight pipe 28 is slightly pointed outward toward the inner wall of the tube, as shown in FIGS. 2 and 3. Similarly, straight pipe 33 of the second pipe set is slightly pointed outward toward the inner wall of the tube in the second section of silencer 10.

Figure 4:
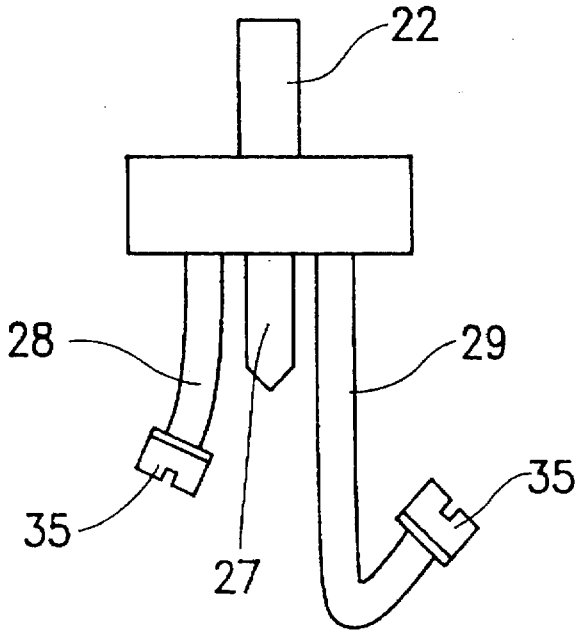
FIG. 4 is a schematic diagram of the first pipe set.

FIG. 4 illustrates a more detailed structure of the first pipe set. Bent pipe 29 is longer than straight pipe 28. This designation will result in an intersection of injection directions of the two pipes when the support bases 24 rotate. Therefore, all regions in the first section of silencer 10 can be covered by the injected water of the pipes. Moreover, nozzles 35 which cause the injected water to spread widely are installed at water output ends of pipes 28 and 29. Therefore, the first section of silencer 10 can be completely cleaned by the first pipe set.

A fixing end 27 is also provided by fixing plate 22 between pipes 28 and 29. Fixing end 27 is utilized to attach the inner axis of silencer 10, thus fixing the upper end of silencer 10 to fixing plate 22. Since both pipes 28 and 29 are longer than fixing end 27 and are pointed outward, a small portion of the inner axis near fixing end 27 can not be cleaned when the first pipe set is inserted into the first section. In order to overcome this problem, the first pipe set can be pulled up and down freely. When the first pipe set is pulled up to a position higher than the contact point of the inner axis and fixing end 27, the water injected from nozzle 35 can clean the end portion of the inner axis.

Figure 5:
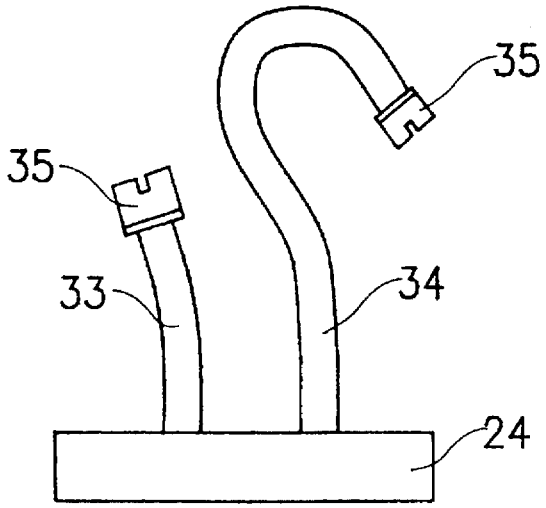
FIG. 5 is a schematic diagram of the second pipe set.

FIG. 5 illustrates a more detailed structure of the second pipe set The design of the second pipe set is similar to that of the first pipe set, except for the absence of fixing end 27. Since the inner axis is shorter in the second section of silencer 10, more space is left for the second pipe set. Bent pipe 34 is longer than straight pipe 33. Nozzles 35 of wider spreading range are also installed at output ends of pipes 33 and 34. Therefore, the second pipe set can completely clean all regions in the second section of silencer 10.

As persons skilled in this art may well appreciate, the above description of the preferred embodiment of the present invention is employed for the purposes of description, not to restrict the scope of to the present invention. Modifications to the outlined embodiment of the present invention may be apparent and should be considered to be within the scope of the present invention that is recited in the claims that follow.

What is claimed is:

1. A cleaning apparatus for cleaning an air pump silencer; the silencer having a tube, two caps at both opposite ends, and an inner axis fixed on the tube by a spacer; the spacer separating the silencer into a first section and a second section; the cleaning apparatus comprising:

a housing;

at least one rotary part in the housing, each including a fixing plate and a support base, for fixing the silencer;

a first pipe set mounted on the fixing plate, including a straight pipe and a bent pipe, for injecting water to clean the first section of the silencer;

a second pipe set mounted on the support base, including a straight pipe and a bent pipe, for injecting water to clean the second section of the silencer;

a driving portion for driving the support base of the rotary parts to rotate; and a control circuit for controlling the driving portion.

2. The apparatus of claim 1 further comprising a water tank in the housing for providing water to the pipe sets.

3. The apparatus of claim 1 further comprising an acid tank in the housing for receiving materials washed out of the pump silencer.

4. The apparatus of claim 1, wherein the bent pipe of the first pipe set is pointed at the adjoining region of the tube and the cap in the first section of the silencer.

5. The apparatus of claim 1, wherein the bent pipe of the second pipe set is pointed at the adjoining region of the tube and the cap in the section of the silencer.

6. The apparatus of claim 1 further comprising a fixing end provided by the fixing plate between the bent pipe and the straight pipe of the first pipe set; the upper end of the silencer being fixed by attaching the inner axis to the fixing end.

7. The apparatus of claim 1, wherein the bent pipes are longer than the straight pipes.

8. The apparatus of claim 1, wherein the pipes of the pipe sets each has a nozzle to inject water.

9. The apparatus of claim 1, wherein the pipe sets are fixed when the support base rotates.

10. A cleaning apparatus for cleaning an air pump silencer; the silencer having a tube, two caps at both opposite ends of the tube, and an inner axis fixed on the tube by a spacer; the spacer separating the silencer into a first section and a second section; the caps having openings; the cleaning apparatus comprising:

a closed housing;

at least one rotary part, in the housing, including a fixing plate and a support base, for vertically fixing the silencer;

a first pipe set mounted on the fixing plate, including a straight pipe and a bent pipe, the first pipe set being arranged so as to be inserted into the silencer through the opening of the cap, for injecting water to clean the first section of the silencer;

a fixing end provided by the fixing plate between the bent pipe and the straight pipe of the first pipe set for fixing the upper end of the silencer by attaching the inner axis;

a second pipe set mounted on the support base, including a straight pipe and a bent pipe, the second pipe set being arranged so as to be inserted into the silencer through the opening of the cap, for injecting water to clean the second section of the silencer;

a driving portion for driving the support base of the rotary parts to rotate;

a control circuit for controlling the driving portion;

a water tank in the housing for providing water to the pipe sets; and an acid tank in the housing for receiving materials washed out of the pump silencer.

11. The apparatus of claim 10, wherein the bent pipe of the first pipe set is pointed at the adjoining region of the tube and the cap in the first section of the silencer.

12. The apparatus of claim 10, wherein the bent pipe of the second pipe set is pointed at the adjoining region of the tube and the cap in the section of the silencer.

* * * * *